US007924230B2

(12) United States Patent
Hung et al.

(10) Patent No.: US 7,924,230 B2
(45) Date of Patent: Apr. 12, 2011

(54) MULTI-FREQUENCY ANTENNA SUITABLY WORKING IN DIFFERENT WIRELESS NETWORKS

(75) Inventors: Chen-Ta Hung, Tu-Cheng (TW); Hsien-Sheng Tseng, Tu-Cheng (TW); Lung-Sheng Tai, Tu-Cheng (TW); Shu-Yean Wang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 174 days.

(21) Appl. No.: 12/378,644

(22) Filed: Feb. 17, 2009

(65) Prior Publication Data

US 2009/0153430 A1 Jun. 18, 2009

Related U.S. Application Data

(63) Continuation of application No. 11/906,691, filed on Oct. 2, 2007, now Pat. No. 7,498,992, which is a continuation of application No. 11/201,463, filed on Aug. 11, 2005, now Pat. No. 7,289,071.

(30) Foreign Application Priority Data

May 23, 2005 (TW) ..... 94116677 A

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 6,456,243 | B1 | 9/2002 | Poilasne et al. | |
| 6,507,322 | B2 | 1/2003 | Fang et al. | |
| 6,639,560 | B1 | 10/2003 | Kadambi et al. | |
| 6,714,162 | B1 | 3/2004 | Kadambi et al. | |
| 6,717,551 | B1 | 4/2004 | Desclos et al. | |
| 6,906,667 | B1 | 6/2005 | Poilasne et al. | |
| 6,919,857 | B2 | 7/2005 | Shamblin et al. | |
| 6,950,069 | B2 | 9/2005 | Gaucher et al. | |
| 6,992,627 | B1 | 1/2006 | Honda et al. | |
| 7,161,543 | B2 | 1/2007 | Cheng et al. | |
| 7,170,452 | B2 * | 1/2007 | Yang | 343/702 |
| 7,230,571 | B2 * | 6/2007 | Gaucher et al. | 343/700 MS |
| 2004/0090378 | A1 * | 5/2004 | Dai et al. | 343/700 MS |
| 2004/0174305 | A1 | 9/2004 | Kuo et al. | |
| 2005/0093752 | A1 | 5/2005 | Cheng et al. | |

* cited by examiner

*Primary Examiner* — Hoang V Nguyen
(74) *Attorney, Agent, or Firm* — Wei Te Chung; Andrew C. Cheng; Ming Chieh Chang

(57) ABSTRACT

A multi-frequency antenna includes a first antenna (1) and a second antenna (2) both operating at wireless wide area network, a third antenna (3) and a fourth antenna (4) both operating at wireless local area network. The first antenna, the second antenna, the third antenna and the fourth antenna are integrally made from a metal sheet and have a common grounding portion (50). The first and the second antennas have a first connecting portion (12) on which a feeding point (120) is located, and the third and the fourth antenna have a second connecting portion (34) on which another feeding point (340) is located.

20 Claims, 5 Drawing Sheets

MULTI-FREQUENCY ANTENNA SUITABLY WORKING IN DIFFERENT WIRELESS NETWORKS

CROSS-REFERENCE TO RELATED APPLICATION

This application is a CA (Continuation of Application) of U.S. patent application Ser. No. 11/906,691, filed Oct. 2, 2007, now U.S. Pat. No. 7,498,992, which is a CA of application Ser. No. 11/201,463, filed Aug. 11, 2005, now U.S. Pat. No. 7,289,071.

BACKGROUND OF THE INVENTION

1. Field of the Invention

The present invention relates generally to an antenna, and more particularly to a multi-frequency antenna for a wireless communication device.

2. Description of Prior Art

With the high-speed development of the mobile communication, people more and more expect to use a computer or other portable terminals to optionally connect to Internet. GPRS (General Packer Radio Service) and WLAN (Wireless Local Area Network) allow users to access data wirelessly over both cellular networks and 802.11b WLAN system. When operating in GPRS, the data transmitting speed is up to 30 Kbps~50 Kbps, while when connected to a WLAN access point, the data transmitting speed is up to 11 Mbps. People can select different PC cards and cooperate with the portable terminals such as the notebook computer and etc. to optionally connect to Internet. Since WLAN has a higher transmitting speed, WLAN is usually used to provide public WLAN high-speed data service in some hot areas (for example, hotel, airport, coffee bar, commerce heartland, conference heartland and etc.). When leaving from these hot areas, network connection is automatically switched to GPRS.

As it is known to all, an antenna plays an important role in wireless communication. As a result, the PC card may choose individual antennas to respectively operate at WWAN (Wireless Wide Area Network), namely GPRS, and WLAN. However, the two individual antennas will inevitably occupy more space than a single antenna in general. Hence, it is necessary to be concerned by researchers skilled in the art how to incorporate two antennas respectively operating at WWAN and WLAN into a single antenna.

SUMMARY OF THE INVENTION

An object of the present invention is to provide a multi-frequency antenna which can integrate the antenna for WWAN and the antenna for WLAN together, thereby reducing the installation space of the antenna and the antenna having the excellent performance.

To achieve the aforementioned object, the present invention provides a multi-frequency antenna comprising a grounding element, a first type of antenna, and a second type of antenna. The first type of antenna works in a first wireless network including a first radiating body and a first connecting portion connecting the grounding element and the first radiating body. The second type of antenna works in a second wireless network including a second radiating body and a second connecting portion connecting the grounding element and the second radiating body. The first connecting portion is longer than the second connecting portion, and the first radiating body is longer than the second radiating body.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
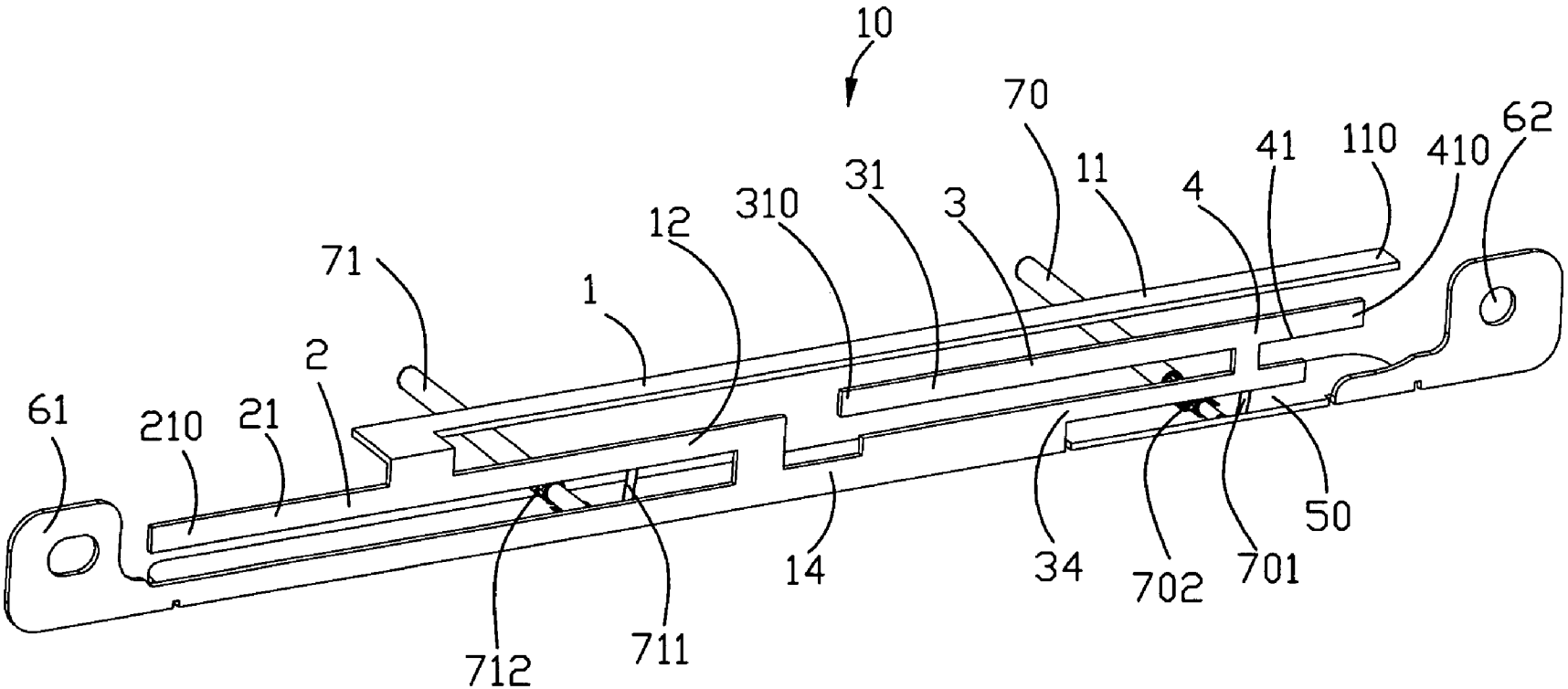
FIG. 1 is a perspective view of a multi-frequency antenna in accordance with a preferred embodiment of the present invention.
Figure 2:
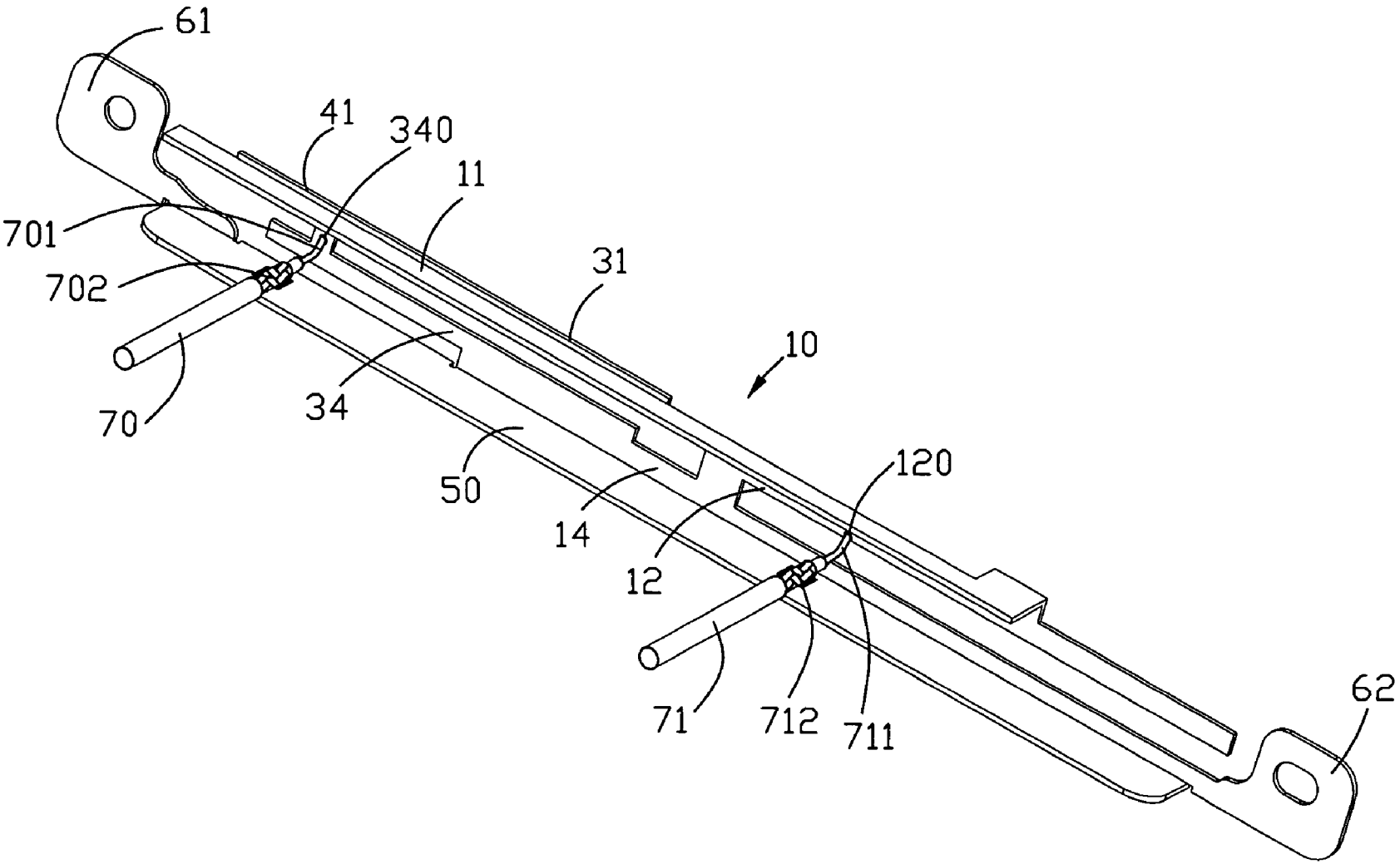
FIG. 2 is a view similar to FIG. 1, but from a different aspect.

Referring to FIGS. 1 and 2, a multi-frequency antenna 10 in accordance with a preferred embodiment of the present invention comprises a first type of antenna which is used in WWAN and has first and second antennas 1, 2, and a second type of antenna which is used in WLAN and has third and fourth antenna 3, 4. The multi-frequency antenna 10 is integrally made from a metal sheet and can integrate the first type of antenna for WWAN and the second type of antenna for WLAN together.

The multi-frequency antenna 10 has a first installing portion 61 and a second installing portion 62 at opposite ends thereof, which form an installing plane. The multi-frequency antenna 10 comprises a common grounding portion 50 for the first, the second, the third and the fourth antennas 1, 2, 3, 4. A lengthwise portion 14 extends perpendicularly and upwardly from the grounding portion 50, which is connected to the first installing portion 61 at one end thereof. The first antenna 1 and the second antenna 2 include a first connecting portion 12 extending upwardly from the lengthwise portion 14. The first antenna 1 comprises a first radiating element 11, which is coupled to the grounding portion 50 by the first connecting portion 12 and the lengthwise portion 14. The first radiating element 11 is designed in a tri-dimensional manner and extends in a lengthwise direction, thereby reducing the width of the installing plane in a traverse direction. A plane in which the first connecting portion 12 and the lengthwise portion 14 are located is defined as a first plane, a plane in which the first radiating element 11 is located is defined as a second plane, and a plane in which the grounding portion 50 is located is defined as a third plane. The first plane is respectively orthogonal to the second plane and the third plane, and the first plane and the installing plane are coplanar. The radiating element 11 of the first antenna 1 extends towards the second installing portion 62 in the first plane with a free end 110 thereof adjacent to the second installing portion 62. The central frequency the first antenna 1 operates at is about 900 MHz. The second antenna 2 comprises a second radiating element 21, which extends from the first connecting portion 12 towards the first installing portion 61 with a free end 210 thereof close to the installing portion 61. The second radiating element 21 is shorter than the first radiating portion 11. The central frequency the second antenna 2 operates at is about 1900 MHz. A feeding point 120 for the first antenna 1 and the second antenna 2 is located on the first connecting portion 12. The first and the second antennas 1, 2 are provided power by a first coaxial cable 70 with an inner conductor 701 of the coaxial cable 70 welded to the feeding point 120 and an outer conductor 702 welded to the grounding portion 50. Both of the first antenna 1 and the second antenna 2 are inverted-F antennas.

The third antenna 3 comprises a third radiating element 31, and the fourth antenna 4 comprises a fourth radiating element 41. The fourth radiating element 41 is shorter than the third radiating element 31. Total length of the third radiating element 31 and the fourth radiating element 41 is shorter than the first radiating element 11 and the second radiating element 21. The third and the fourth antennas have a second connecting portion 34 connected to an end of the lengthwise portion 14. The second connecting portion 34 is shorter than the first connecting portion 12. The third and fourth radiating element 31, 41 is connected to the grounding portion 50 by the second connecting portion 34 and the lengthwise portion 14, thereby forming two inverted-F antennas. The third and the fourth radiating element 31, 41 are arranged in a line and extend from an end of the second connecting portion 34 in opposite directions. The third radiating element 31 extends towards the first installing portion 61 and the fourth radiating element 41 extends towards the second installing portion 62. A feeding point 340 for the third antenna 3 and the fourth antenna 4 is located on the second connecting portion 34. Likewise, the third and the fourth antennas 3, 4 are provided power by a second coaxial cable 71 with an inner conductor 711 of the coaxial cable 71 welded to the feeding point 340 and an outer conductor 712 welded to the grounding portion 50. The third antenna operates at the central frequency of 2.4 GHz and the fourth antenna operates at the central frequency of 5.2 GHz.

The first radiating element 11 of the first antenna 1 operating at WWAN and the third radiating element 31 of the third antenna 3 operating at WLAN are interlaced with each other so as to make the distance between the two free ends 110, 310 as far as possible for reducing the interference between the two antennas 1, 3. The interval between the central frequencies of the second antenna 2 and the third antenna 3 is smallest so that the interference between the two antennas can be produced easily. In the preferred embodiment, the space between the second antenna 2 and the third antenna 3 may make both of the antennas work perfectly. The second radiating element 21 of the second antenna 2, the third radiating element 31 of the third antenna, the fourth radiating element 41 of the fourth antenna 4, the first and second connecting portions 12, 34 and the lengthwise portion 14 are positioned on an identical planar, namely the first planar. The multi-frequency antennas of the preferred embodiment can be attached to two opposite sides in an upper end of the display of a computer, and can be fed power by feeding lines so as to make the multi-frequency antenna be employed at different wireless network cards.

Figure 3:
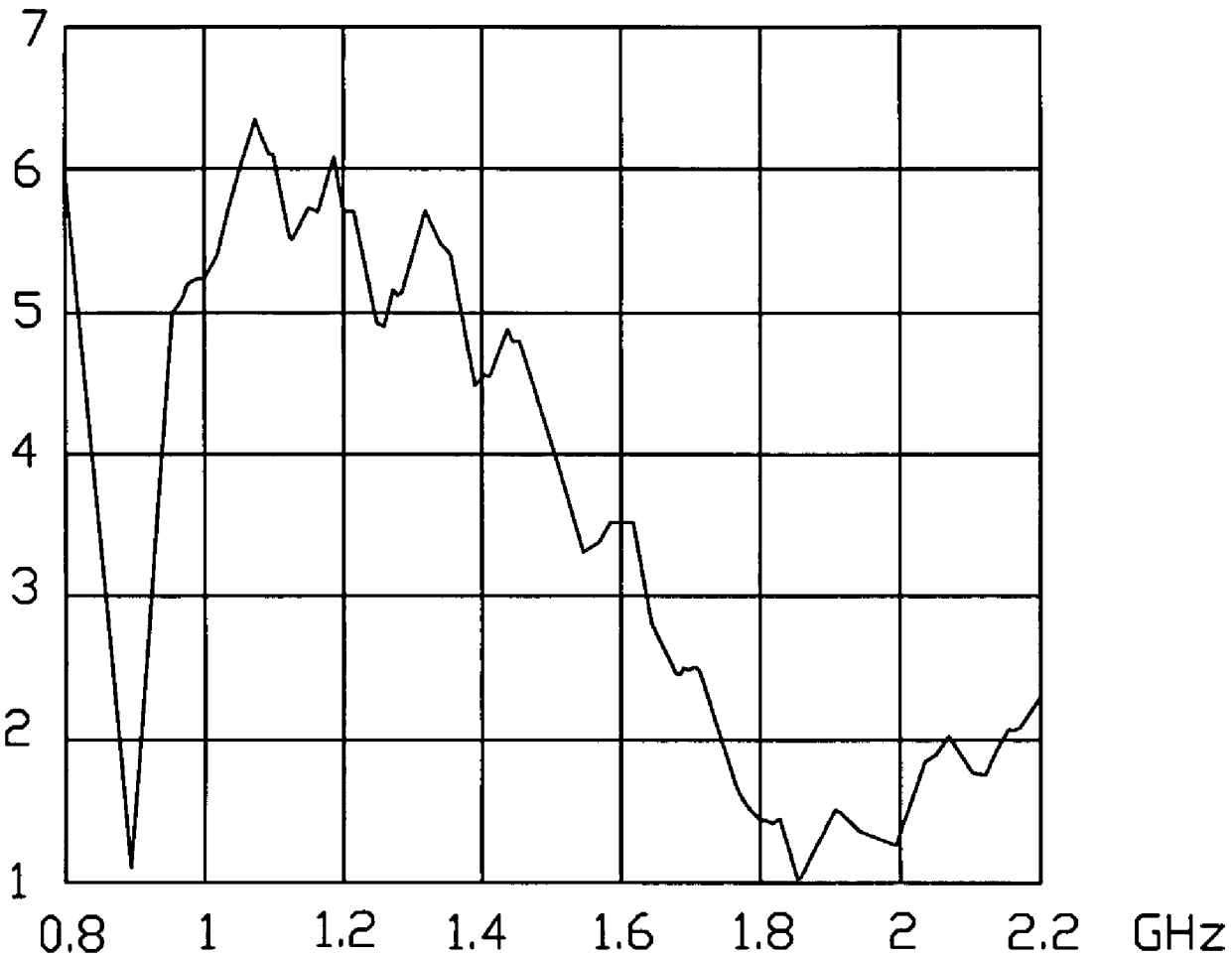
FIG. 3 is a test chart recording for the multi-frequency antenna of FIG. 1, showing Voltage Standing Wave Ratio (VSWR) as a function of WWAN frequency.
Figure 4:
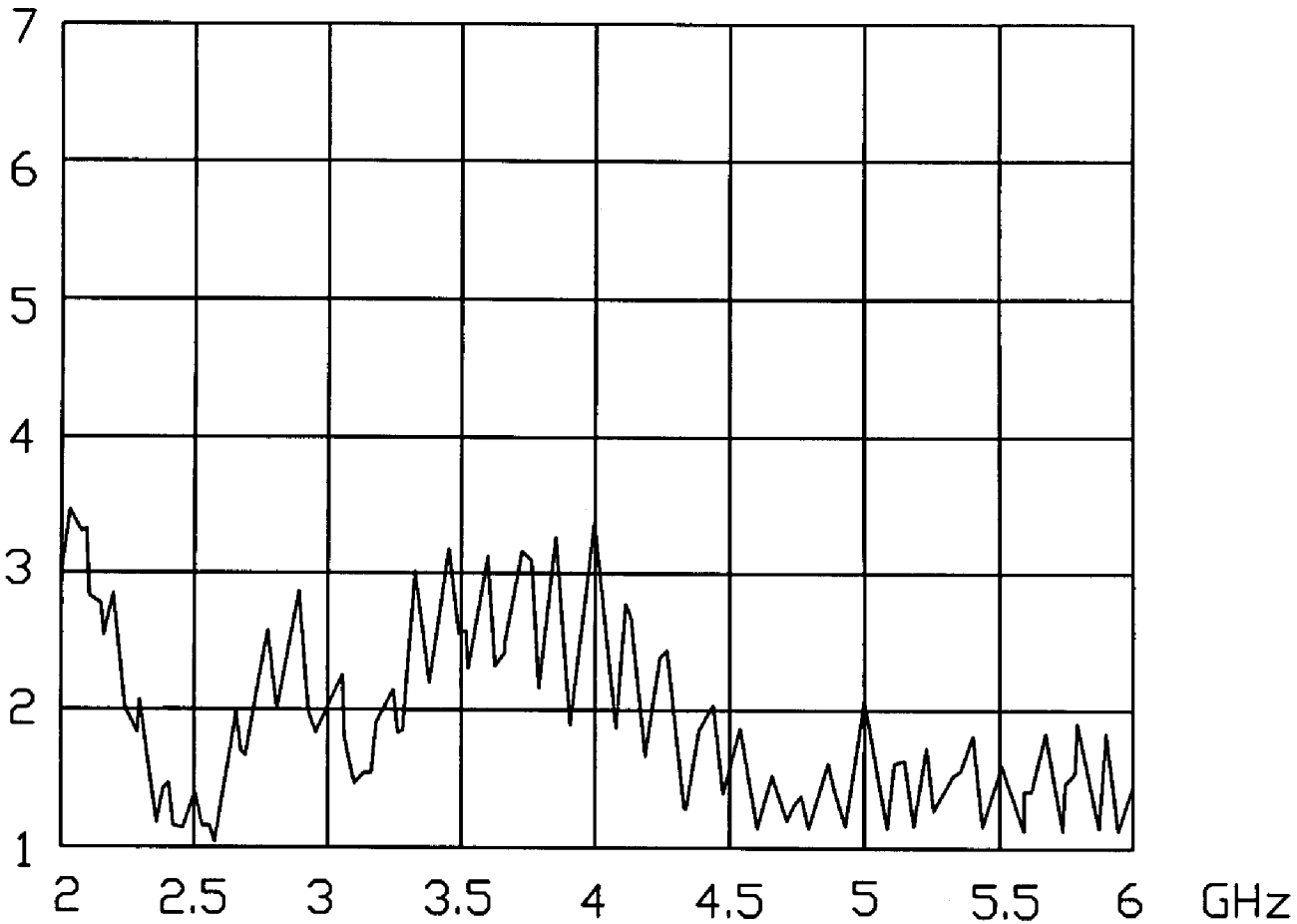
FIG. 4 is a test chart recording for the multi-frequency antenna of FIG. 1, showing Voltage Standing Wave Ratio (VSWR) as a function of WLAN frequency.
Figure 5:
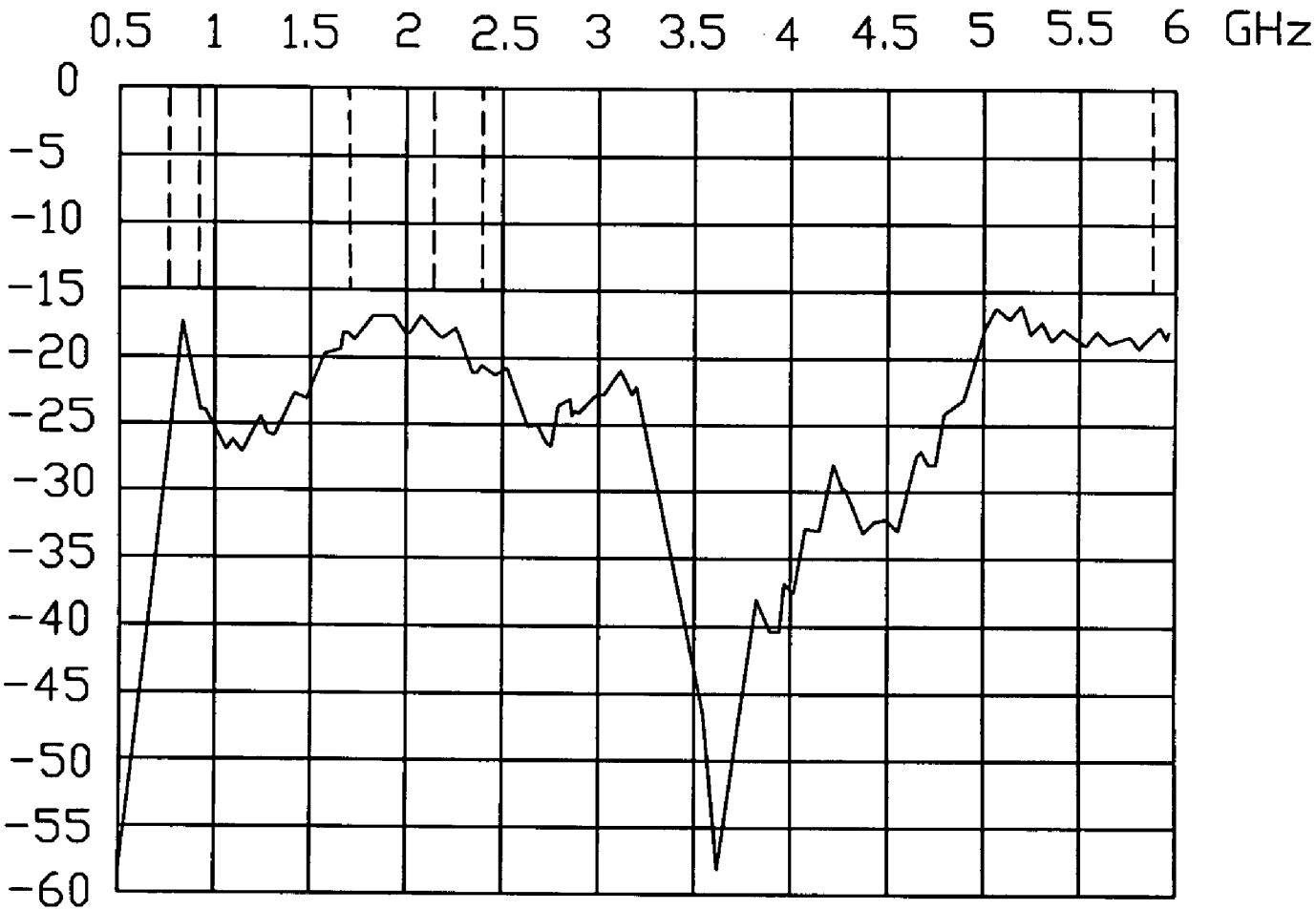
FIG. 5 is a test chart recording for the multi-frequency antenna of FIG. 1, showing isolation as a function of frequency.

FIG. 3 is a test chart of Voltage Standing Wave Ratio (VSWR) of the combined WWAN antennas, wherein x-coordinate defines frequency and y-coordinate defines VSWR. Likewise, FIG. 4 is a test chart of Voltage Standing Wave Ratio (VSWR) of the combined WLAN antennas, wherein x-coordinate defines frequency and y-coordinate defines VSWR. A perfect value of VSWR is 1 dB that is considered having best receiving quality. Generally speaking, VSWR under 2 dB is considered having good receiving quality. Under the definition of the VSWR less than 2 dB, it can be clearly seen from FIG. 3 that the values of the VSWR around 900 MHz and 1900 MHz can satisfy the definition as well as the values of the VSWR around 2.4 GHz and 5.2 GHz in FIG. 4 can satisfy the definition so that the efficiency for receiving the frequencies is excellent. FIG. 5 is a test chart of isolation of the multi-frequency antenna with x-coordinate defining frequency and y-coordinate defining isolation. It can be seen that the values of the isolation during the frequencies of WWAN and WLAN are less than −15 dB and can satisfy the requirement in practice.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-frequency antenna for being assembled in an electrical device, comprising:

a grounding element;

a first connecting portion and a second connecting portion;

a first radiating portion extending from the first connecting portion and working on a first frequency band;

a second radiating portion extending from the first connecting portion and working on a second frequency band;

a third radiating portion extending from the second connecting portion and working on a third frequency band; and a fourth radiating portion extending from the second connecting portion and working on a fourth frequency band;

said grounding element, the first and second connecting portions, the first, second, third, and fourth radiating portion being integrated to be assembled in the electrical device;

further comprising a lengthwise portion extending from the grounding element, the first and second connecting portions respectively extend from the lengthwise portion along the second and first directions.

2. The multi-frequency antenna as claimed in claim 1, further comprising a first and second installing portion respectively extending from the two ends of the grounding element.

3. The multi-frequency antenna as claimed in claim 1, wherein both said first connecting portion and second connecting portion extend from the grounding element.

4. The multi-frequency antenna as claimed in claim 1, wherein the first radiating portion and the second radiating portion respectively extend along the first direction and the second direction, the third radiating portion and the fourth radiating portion respectively extend along the second direction and the first direction, and the third radiating portion and the fourth radiating portion are located between the first radiating portion and the grounding element in a vertical direction.

5. The multi-frequency antenna as claimed in claim 1, further comprises a coupling radiating portion located between the fourth radiating portion and the grounding element, said coupling radiating portion works at a fifth frequency band.

6. The multi-frequency antenna as claimed in claim 5, wherein the coupling radiating portion extends from the second connecting portion, and the coupling radiating portion, the second connecting portion, the first and second radiating portion form an inverted H shape.

7. The multi-frequency antenna as claimed in claim 1, wherein the first radiating portion and the second radiating portion works in the wireless wide area net, and the third radiating portion and the fourth radiating portion works in the wireless local area net.

8. A multi-frequency antenna for being used in an electrical devices, comprising:

a first grounding position and a second grounding position spaced from each other;

a first connecting portion extending from the first grounding position;

a second connecting portion extending from the second grounding position;

a first radiating portion and a second radiating portion respectively extending from the first connecting portion; and a third radiating portion and a fourth radiating portion respectively extending from the second connecting portion;

said four radiating portions respectively working at four different frequency bands; wherein the first radiating portion and the second radiating portion respectively extends along a first direction and a second direction, said third radiating portion and the fourth radiating portion respectively extends along the second direction and the first direction.

9. The multi-frequency antenna as claimed in claim 8, wherein said first grounding position and said second position are located on a same grounding element.

10. The multi-frequency antenna as claimed in claim 9, further comprising a first and a second installing portions extending from two opposite ends of the grounding element, respectively.

11. The multi-frequency antenna as claimed in claim 8, further comprises a coupling radiating portion located between the fourth radiating portion and the grounding element, said coupling radiating portion works at a fifth frequency band.

12. The multi-frequency antenna as claimed in claim 8, wherein said first connecting portion is separated from the second grounding position so as to form a slot therebetween.

13. The multi-frequency antenna as claimed in claim 8, wherein the third radiating portion and the fourth radiating portion are located between the first radiating portion and the grounding element.

14. A multi-frequency antenna comprising for being assembled in an electrical device, comprising:

a first connecting portion including at least a first downwardly lying L-shaped configuration having a first upward section and a first transverse section;

a second connecting portion including at least second downwardly lying L-shaped configuration having a second upward section and a second transverse section;

a first radiating portion extending from the first connecting portion and working on a first frequency band;

a second radiating portion extending from the first connecting portion and working on a second frequency band;

a third radiating portion extending from the second connecting portion and working on a third frequency band; and a fourth radiating portion extending form the second connecting portion and working on a fourth frequency band; wherein said first upward section and said second upward section are directly grounded under condition that the second connection portion and the associated third radiating portion and fourth radiation portion are located in a space essentially defined vertically under the first radiating portion and laterally beside the first connection portion.

15. The multi-frequency antenna as claimed in claim 14, wherein the first upward section and the second upward section are positioned closer to each other while the first transverse section the second transverse section extending oppositely away from each other from the corresponding first upward section and second upward section, respectively.

16. The multi-frequency antenna as claimed in claim 14, wherein said first upward section and said second upward section are commonly grounded to a same grounding element.

17. The multi-frequency antenna as claimed in claim 16, wherein said space is located vertically above said grounding element.

18. The multi-frequency antenna as claimed in claim 14, wherein the fourth radiating portion is essentially horizontally aligned with the third horizontal section.

19. The multi-frequency antenna as claimed in claim 14, wherein said first upward section and said second upward section both extend vertically, and said first transverse direction and said second transverse sections both extend horizontally.

20. A multi-frequency antenna for being assembled in an electrical device, comprising:

a grounding element;

a first connecting portion and a second connecting portion;

a first radiating portion extending from the first connecting portion and working on a first frequency band;

a second radiating portion extending from the first connecting portion and working on a second frequency band;

a third radiating portion extending from the second connecting portion and working on a third frequency band; and a fourth radiating portion extending from the second connecting portion and working on a fourth frequency band;

said grounding element, the first and second connecting portions, the first, second, third, and fourth radiating portion being integrated to be assembled in the electrical device; wherein the first radiating portion and the second radiating portion respectively extend along a first direction and a second direction, the third radiating portion and the fourth radiating portion respectively extends along the second direction and the first direction, and the third radiating portion and the fourth radiating portion are located between the first radiating portion and the grounding element in a vertical direction.

* * * * *